US006406572B1

(12) United States Patent
Ernst et al.

(10) Patent No.: US 6,406,572 B1
(45) Date of Patent: Jun. 18, 2002

(54) PROCESS FOR THE PRODUCTION OF A WORKPIECE FROM A CHROMIUM ALLOY, AND ITS USE

(75) Inventors: Peter Ernst, Stadel; Peter Uggowitzer, Ottenbach; Hannes Speidel, Turgi; Markus Speidel, Birmenstorf, all of (CH)

(73) Assignee: ABB Research Ltd, Zurich (CH)

( * ) Notice: Subject to any disclaimer, the term of this patent is extended or adjusted under 35 U.S.C. 154(b) by 0 days.

(21) Appl. No.: 09/178,579

(22) Filed: Oct. 26, 1998

(30) Foreign Application Priority Data

Oct. 31, 1997 (DE) ..... 197 48 205

(51) Int. Cl.[7] ..... C22F 1/16
(52) U.S. Cl. ..... 148/707; 148/668
(58) Field of Search ..... 148/707, 668, 148/676

(56) References Cited

U.S. PATENT DOCUMENTS

| | | | |
|---|---|---|---|
| 4,400,209 A | | 8/1983 | Kudo et al. |
| 4,400,210 A | | 8/1983 | Kudo et al. |
| 4,421,571 A | | 12/1983 | Kudo et al. |
| 4,424,083 A | | 1/1984 | Polizzotti et al. |
| 4,761,190 A | * | 8/1988 | Smith |
| 5,378,427 A | | 1/1995 | Otsuka et al. |
| 5,695,716 A | * | 12/1997 | Kohler et al. |

FOREIGN PATENT DOCUMENTS

| | | |
|---|---|---|
| DE | 4342188 A1 | 6/1995 |
| EP | 0657556 A1 | 6/1995 |
| JP | 61-41746 | 2/1986 |
| JP | 62-180037 | 8/1987 |
| JP | 08120392 | 5/1996 |

OTHER PUBLICATIONS

"Nicrofer 3033–alloy 33", Krupp VDM publication, Jun. 1995.

* cited by examiner

*Primary Examiner*—John Sheehan
(74) *Attorney, Agent, or Firm*—Burns, Doane, Swecker & Mathis, L.L.P.

(57) ABSTRACT

In a process for producing a workpiece from a chromium alloy, consisting of:

| | | |
|---|---|---|
| 32–37 | % by weight | chromium, |
| 28–36 | % by weight | nickel, |
| max. 2 | % by weight | manganese, |
| max. 0.5 | % by weight | silicon, |
| max. 0.1 | % by weight | aluminum, |
| max. 0.03 | % by weight | carbon, |
| max. 0.025 | % by weight | phosphorus, |
| max. 0.01 | % by weight | sulfur, |
| max. 2 | % by weight | molybdenum, |
| max. 1 | % by weight | copper, |
| 0.3–0.7 | % by weight | nitrogen, |

remainder iron and production-related admixtures and impurities, the workpiece is cold worked and, by means of the cold working, is brought to a yield strength of at least 1000 MPa ($R_p \geqq 1000$ MPa).

13 Claims, 1 Drawing Sheet

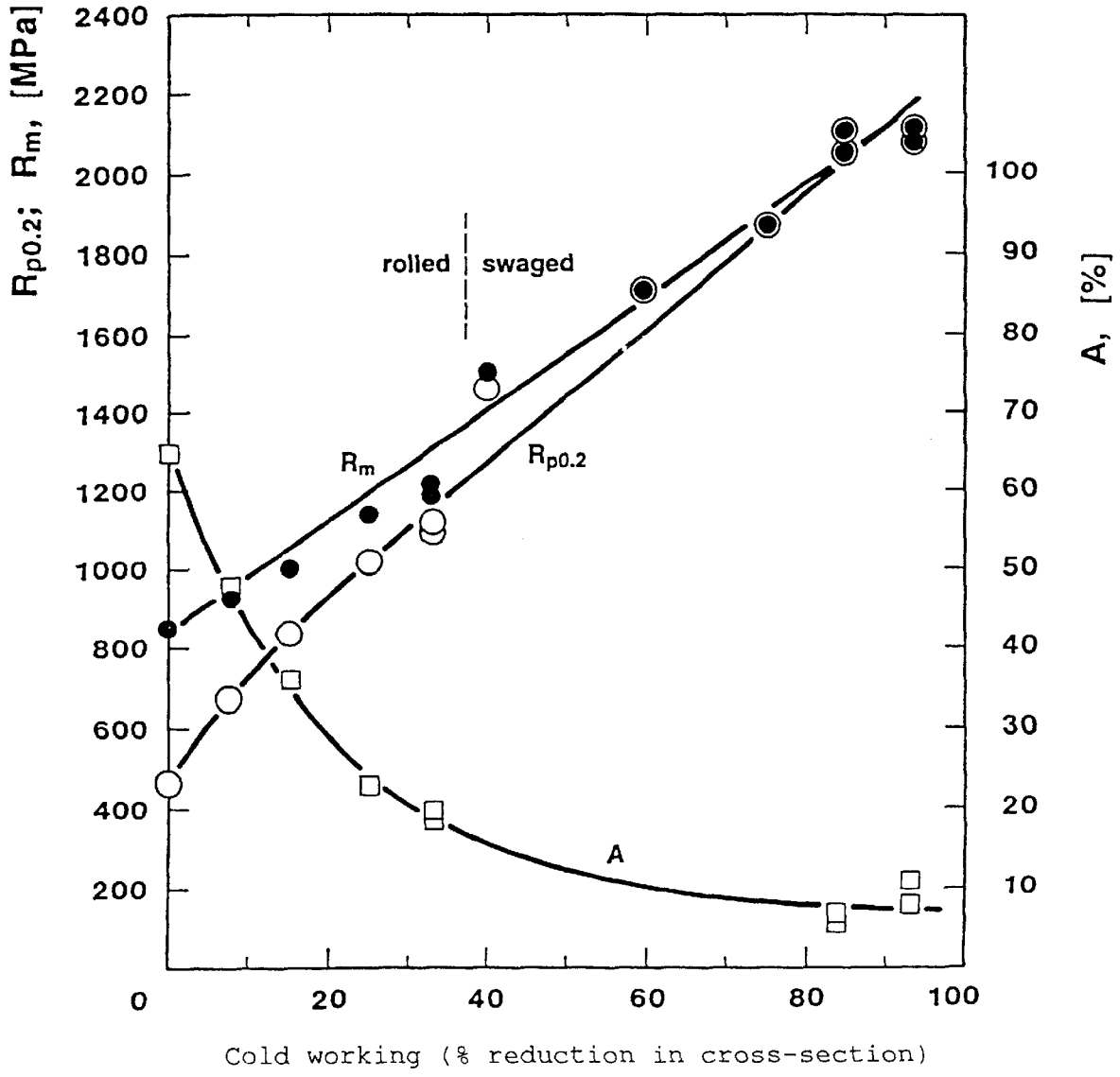
$R_{p0.2}$; $R_m$, [MPa]
2400
2200
2000
1800
1600
1400
1200
1000
800
600
400
200
0
20
40
60
80
100
A, [%]
100
90
80
70
60
50
40
30
20
10
rolled
swaged
$R_m$
$R_{p0.2}$
A
Cold working (% reduction in cross-section)

PROCESS FOR THE PRODUCTION OF A WORKPIECE FROM A CHROMIUM ALLOY, AND ITS USE

BACKGROUND OF THE INVENTION

1. Field of the Invention

The invention is based on a process for producing a workpiece from a chromium alloy in accordance with the preamble of the first claim. The invention also relates to the use of the workpiece produced using the process.

2. Discussion of Background

In power engineering, in particular for retaining rings in the construction of turbine generators, in offshore engineering, in aeronautical and aerospatial engineering, in architecture, in general mechanical engineering, in the chemical industry and in transport engineering, there is a need for materials which, in addition to having a very high strength, toughness and freedom from ferromagnetism, are also free from susceptibility to corrosion and stress corrosion cracking, both in water and in aqueous halide solutions. However, materials which fulfill all these conditions to a satisfactory extent have not yet been discovered. Therefore, in each instance it is attempted to select materials for the particular application field in such a way that at least the most important properties are covered, in order to prevent failure of the material. In so doing, it is accepted that when operating conditions change subsidiary properties of the material, which have not been taken into account to a sufficient extent, may cause the material to fail.

For retaining rings used in the construction of turbine generators, steels of the composition 18% Cr, 18% Mn, 0.6% N or 18% Mn, 5% Cr, 0.55% C, for example, are employed. Although these materials do have the desired high strength, toughness and freedom from ferromagnetism, their corrosion and stress corrosion cracking properties may become a problem under particularly corrosive operating and environmental conditions.

EP 0,657,556 A1 has disclosed an alloy of the composition:

| | | |
|---|---|---|
| 32–37 | % by weight | chromium, |
| 28–36 | % by weight | nickel, |
| max. 2 | % by weight | manganese, |
| max. 0.5 | % by weight | silicon, |
| max. 0.1 | % by weight | aluminum, |
| max. 0.03 | % by weight | carbon, |
| max. 0.025 | % by weight | phosphorus, |
| max. 0.01 | % by weight | sulfur, |
| max. 2 | % by weight | molybdenum, |
| max. 1 | % by weight | copper, |
| 0.3–0.7 | % by weight | nitrogen, |

remainder iron and production-related admixtures and impurities.

Although these alloys which are described in EP 0,657,556 A1 do have a desired high level of resistance to general corrosion, their yield strengths ("elongation limits") only reach a maximum of about 500 MPa and their tensile strengths only reach approximately 850 MPa. However, this is not sufficient for the abovementioned demands for extremely high strengths which are fulfilled by the alloys described previously.

The alloy described in EP 0,657,556 A1 is marketed by the company Krupp VDM under the name Nicrofer® 3033—alloy 33. The associated materials data sheet, Krupp VDM, Nicrofer® 3033—alloy 33, materials data sheet No. 4142, June 1995 issue, states that workpieces, following 15% cold deformation, should be subjected to a heat treatment which is to be carried out at temperatures of from 1080 to 1150° C., preferably at 1120° C. In order to achieve optimum corrosion properties, following the heat treatment cooling is to be accelerated by means of water. Following the heat treatment, the workpieces have the low strength properties described above.

SUMMARY OF THE INVENTION

Accordingly, one object of the invention, using a process for producing a workpiece from a chromium alloy of the type mentioned at the outset, is to provide a material of high strength and toughness and with a high level of freedom from ferromagnetism and freedom from susceptibility to stress corrosion cracking, both in water and in aqueous halide solutions.

The essence of the invention is therefore that the workpiece is cold worked and, by means of the cold working, is brought to a yield strength of at least 1000 MPa ($R_p \geqq 1000$ MPa).

The advantages of the invention are to be seen, inter alia, in the fact that degrees of cold deformation (reduction in cross section as a result of cold working) of 20 percent and more, up to over 90 percent, bring about excellent combinations of mechanical, physical and chemical properties. It is thus possible to achieve yield strengths of from 1000 MPa to well over 2000 MPa while still retaining a good level of toughness (elongation at break of from 5 to over 10 percent). The result is a material of extremely high strength which is able to satisfy the demands of modern engineering.

A further advantage is the particular physical and chemical properties, which are not to be found in conventional materials of the same strength and the same resistance to corrosion. The particular physical properties of the material according to the invention emerge essentially in the absence of ferromagnetism, which is a prerequisite for use as retaining ring material in the construction of turbine generators. Owing to the high stability of its face-centered cubic crystal lattice, the material according to the invention does not exhibit any deformation martensite even after considerable cold working and therefore remains free of ferromagnetism.

The particular chemical properties of the material which has been subjected to considerable cold working according to the invention manifest themselves in the resistance to stress corrosion cracking in water and aqueous halide solutions. Other cold worked, nonferromagnetic, corrosion-resistant materials, even into the class of the "superaustenites", but in particular all steels which have hitherto been conventional in engineering for retaining rings, have always proven susceptible to stress corrosion cracking in the high-strength, cold worked state, at least in hot, aqueous chloride solutions. This is the first time, with the high degree of cold deformation of 20% and more according to the invention, applied to said chromium alloy, that a material has been created which is entirely resistant to stress corrosion cracking in aqueous halide solutions even while retaining extremely high strength, resistance to corrosion and, at the same time, an absence of ferromagnetism.

By means of said method, the present invention has provided a material which, owing to its excellent combination of mechanical strength and toughness as well as corrosion resistance and its resistance to stress corrosion cracking, as well as the absence of ferromagnetism, can be used specifically in the following application areas: power engineering, offshore engineering and oil-drilling engineering, aeronautical and aerospatial engineering, the building and construction industry, general mechanical engineering, the chemical and petrochemical industries.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawing, which illustrates the yield strength $R_{p02}$, the tensile strength $R_m$ and the elongation at break $A_5$ as a function of the degree of cold deformation.

DESCRIPTION OF THE PREFERRED EMBODIMENTS

Workpieces made from chromium-base alloys of the following composition were cold worked.

| | | |
|---|---|---|
| 32–37 | % by weight | chromium, |
| 28–36 | % by weight | nickel, |
| max. 2 | % by weight | manganese, |
| max. 0.5 | % by weight | silicon, |
| max. 0.1 | % by weight | aluminum, |
| max. 0.03 | % by weight | carbon, |
| max. 0.025 | % by weight | phosphorus, |
| max. 0.01 | % by weight | sulfur, |
| max. 2 | % by weight | molybdenum, |
| max. 1 | % by weight | copper, |
| 0.3–0.7 | % by weight | nitrogen, |

remainder iron and production-related admixtures and impurities.

The particularly preferred alloying ranges had the following composition:

| | | |
|---|---|---|
| 32–37 | % by weight | chromium, |
| 28–36 | % by weight | nickel, |
| max. 2 | % by weight | manganese, |
| max. 0.5 | % by weight | silicon, |
| max. 0.1 | % by weight | aluminum, |
| max. 0.03 | % by weight | carbon, |
| max. 0.025 | % by weight | phosphorus, |
| max. 0.01 | % by weight | sulfur, |
| 0.5–2 | % by weight | molybdenum, |
| 0.3–1 | % by weight | copper, |
| 0.3–0.7 | % by weight | nitrogen, |

remainder iron and production-related admixtures and impurities.

These workpieces were subjected to different degrees of cold deformation and the workpieces obtained in this way were tested. The sole FIGURE compares the yield strength $R_{p02}$, the tensile strength $R_m$ and the elongation at break $A_5$ with the degree of cold deformation. As can be seen from the FIGURE, it was possible, with degrees of cold deformation of greater than 25%, to achieve yield strengths of over 1000 MPa. The cold worked workpieces were subjected to various corrosion and stress corrosion cracking tests, in which values at least equal to those of undeformed workpieces were achieved.

EXEMPLARY EMBODIMENT 1

A chromium-base alloy of the following chemical composition

| | |
|---|---|
| 32.9% by weight | chromium |
| 30.9% by weight | nickel |
| 0.64% by weight | manganese |
| 0.31% by weight | silicon |
| 0.01% by weight | carbon |
| 0.01% by weight | phosphorus |
| 1.67% by weight | molybdenum |
| 0.58% by weight | copper |
| 0.39% by weight | nitrogen |

and customary—production-related admixtures and impurities, remainder iron, as a rolled sheet having the dimensions 150 mm×500 mm, in the solution-annealed and quenched state, had the following properties: yield strength $R_{p02}$=466 MPa, tensile strength $R_m$=848 MPa, elongation at break $A_5$=65%, magnetic permeability $\mu_r$<1.004, critical crevice corrosion temperature $T_{CCC}$=20° C. In the form of a bar of 15 mm diameter, the alloy was cold worked by rotary swaging at room temperature to the diameters 11.2 mm, 9.2 mm, 7.2 mm and 5.7 mm, corresponding to cold working of 40%, 59%, 75% and 84%. Even after very considerable cold working, the alloy was homogeneously austenitic, free of precipitations, completely nonmagnetic ($\mu_r$<1.004) and had the following mechanical properties: yield strength $R_{p02}$= 2100 MPa, tensile strength $R_m$=2100 MPa, elongation at break $A_5$=10%. The resistance to local corrosion was not impaired by the cold working, and the critical crevice corrosion temperature, $T_{CCC}$, remained at the level of 20° C, which was equally as high as in the solution-annealed state.

EXEMPLARY EMBODIMENT 2

A solution-annealed rolled plate of the same chemical composition as in Example 1 was deformed by cold rolling starting from the solution-annealed state. The degree of deformation was 25% and 35%. The properties of the alloy which had been cold worked according to the invention are summarized in Table 1. Two comparison alloys are also included in the table. These are the alloys which are most widely used throughout the world at the moment for the application according to the invention as a material for highly stressed generator rotor retaining rings.

The alloy which has been cold worked according to the invention is clearly distinguished by an unusually good combination of strength, ductility and toughness. However, the decisive superiority of the cold worked chromium-base alloy is revealed by the corrosion properties and the resistance to stress corrosion cracking. It is known that the resistance of austenitic steels to corrosion increases proportionately to the chromium, molybdenum and nitrogen content, corresponding to the empirical active sum %Cr+3.3%Mo+20%N. The alloy according to the invention provides an active sum value of about 45. The resistance to corrosion is therefore at a level which is considerably higher than that of the steels which are currently used for generator rotor retaining rings, containing 18% Cr, 18% Mn, 0.6% N or 18% Mn, 5% Cr, 0.55% C. This is revealed experimentally by the critical crevice corrosion temperature, which for the alloy which has been cold worked according to the invention lies at 20° C., while for the alloys containing 18% Cr, 18% Mn, 0.6% N or 18% Mn, 5% Cr, 0.55% C it lies below −3° C.

TABLE 1

| Alloy | Degree of cold deformation [%] | Yield strength $R_{p0.2}$ [MPa] | Tensile strength $R_m$ [MPa] | Elongation at break $A_5$ [%] | Notched bar impact work $A_v$ [J] |
|---|---|---|---|---|---|
| In accordance with Example 2 | 0 | 466 | 848 | 65 | >300 |
| | 25 | 1015 | 1140 | 25 | 218 |
| | 35 | 1110 | 1210 | 22 | 170 |
| 18 Cr, 18 Mn, 0.6N | 0 | 500 | 850 | 65 | 270 |
| | 25 | 1040 | 1160 | 26 | 185 |
| | 35 | 1170 | 1250 | 22 | 150 |
| 18 Mn, 5 Cr 0.55 C | 0 | 460 | 850 | 65 | 200 |
| | 25 | 850 | 1150 | 35 | 85 |
| | 35 | 1050 | 1220 | 28 | 60 |

However, the resistance to stress corrosion cracking of the alloy which has been cold worked according to the invention should be given particular emphasis. To do so, fracture-mechanism tests using prefatigued DCB specimens were carried out in water and 22% strength NaCl solution. After a test period of 2000 h, there was no sign of any crack growth. Thus it is possible to give a value of $<10^{-11}$ m/s as a possible upper limit for crack growth. By contrast, the comparison materials exhibit crack growth of approx. $10^{-9}$ m/s (18% Cr, 18% Mn, 0.6% N) or $10^{-8}$ m/s (18% Mn, 5% Cr, 0.55% C).

Obviously, the invention is not limited to the exemplary embodiments shown and described, and numerous modifications and variations are possible in the light of the above teachings. It is therefore to be understood that within the scope of the appended claims, the invention may be practiced otherwise than as specifically described herein.

What is claimed is:

1. A process for producing a workpiece from a chromium alloy consisting of, in weight %:

| | | |
|---|---|---|
| 32–37 | % by weight | chromium, |
| 28–36 | % by weight | nickel, |
| max. 2 | % by weight | manganese, |
| max. 0.5 | % by weight | silicon, |
| max. 0.1 | % by weight | aluminum, |
| max. 0.03 | % by weight | carbon, |
| max. 0.025 | % by weight | phosphorus, |
| max. 01 | % by weight | sulfur, |
| max. 2 | % by weight | molybdenum, |
| max. 1 | % by weight | copper, |
| 0.39–0.7 | % by weight | nitrogen, |

remainder iron and impurities, wherein the workpiece is cold worked and by means of the cold working is brought to a yield strength of at least 1000 Mpa ($R_p \geqq 1000$ MPa).

2. A process for producing a workpiece from a chromium alloy consisting of, in weight %:

| | | |
|---|---|---|
| 32–37 | % by weight | chromium, |
| 28–36 | % by weight | nickel, |
| max. 2 | % by weight | manganese, |
| max. 0.5 | % by weight | silicon, |
| max. 0.1 | % by weight | aluminum, |
| max. 0.03 | % by weight | carbon, |
| max. 0.025 | % by weight | phosphorus, |
| max. 01 | % by weight | sulfur, |
| 0.5–2 | % by weight | molybdenum, |

-continued

| | | |
|---|---|---|
| 0.3–1 | % by weight | copper, |
| 0.39–0.7 | % by weight | nitrogen, |

remainder iron and impurities, wherein the workpiece is cold worked and by means of the cold working is brought to a yield strength of at least 1000 Mpa ($R_p \geqq 1000$ MPa).

3. The process for producing a workpiece as claimed in claim 1, wherein the degree of cold deformation is at least 20%.

4. The process for producing a workpiece as claimed in claim 1, wherein % Cr+3.3 (% Mo)+20 (% N) is about 45.

5. The process for producing a workpiece as claimed in claim 1, wherein the workpiece has a yield strength of at least 1015 MPa, a tensile strength of at least 1140 MPa and an elongation at break of 22 to 25%.

6. The process for producing a workpiece as claimed in claim 1, wherein the alloy includes 60 to 73% total Ni+Cr.

7. The process for producing a workpiece as claimed in claim 1, wherein the alloy includes $\leqq$39.7% Fe.

8. The process for producing a workpiece as claimed in claim 1, wherein the alloy includes $\geqq$20% Fe.

9. The process for producing a workpiece as claimed in claim 1, wherein the degree of cold working is at least 35% and the yield strength is at least 1200 MPa.

10. A process for producing a workpiece from a chromium alloy consisting of, in weight %:

| | | |
|---|---|---|
| 32–37 | % by weight | chromium, |
| 28–36 | % by weight | nickel, |
| max. 2 | % by weight | manganese, |
| max. 0.5 | % by weight | silicon, |
| max. 0.1 | % by weight | aluminum, |
| max. 0.03 | % by weight | carbon, |
| max. 0.025 | % by weight | phosphorus, |
| max. 01 | % by weight | sulfur, |
| max. 2 | % by weight | molybdenum, |
| max. 1 | % by weight | copper, |
| 0.39–0.7 | % by weight | nitrogen, |

wherein the contents of chromium (Cr), molybdenum (Mo) and nitrogen (N) are adjusted to satisfy the empirical formula: %Cr+3.3% Mo+20% N equal to about 45, and the remainder of the alloy is iron and impurities, the method comprising subjecting the workpiece to cold working in an amount effective to provide the workpiece with a yield strength of at least 1000 MPa ($R_p \geqq 1000$ MPa), elongation at break of at least 5%, the workpiece being nonmagnetic and having a fully austenitic structure after the cold working step.

11. The process for producing a workpiece as claimed in claim 10, wherein the degree of working is at least 35% and the yield strength is at least 1200 MPa.

12. The process for producing a workpiece as claimed in claim 10, wherein the degree of cold working is at least 35% and the elongation at break is 22%.

13. The process for producing a workpiece as claimed in claim 10 wherein the degree of cold working is sufficient to improve stress corrosion cracking resistance of the workpiece.

* * * * *

UNITED STATES PATENT AND TRADEMARK OFFICE

CERTIFICATE OF CORRECTION

PATENT NO. : 6,406,572 B1 
DATED : June 18, 2002
INVENTOR(S) : Peter Ernst, Peter Uggowitzer, Hannes Speidel and Markus Speidel It is certified that error appears in the above-identified patent and that said Letters Patent is hereby corrected as shown below:

Column 5,
Line 54, "$R_{p\leq}$ 1000 MPa" should read -- $R_{p\geq}$ 1000 MPa --.

Signed and Sealed this

Twenty-fourth Day of December, 2002

JAMES E. ROGAN
*Director of the United States Patent and Trademark Office*